US005211583A

United States Patent [19]

Endo et al.

[11] Patent Number: 5,211,583

[45] Date of Patent: May 18, 1993

[54] CONNECTOR

[75] Inventors: Takayoshi Endo; Sakai Yagi; Masanori Tsuji; Motohisa Kashiyama, all of Shizuoka, Japan

[73] Assignee: Yazaki Corporation, Japan

[21] Appl. No.: 951,329

[22] Filed: Sep. 25, 1992

Related U.S. Application Data

[63] Continuation of Ser. No. 857,960, Mar. 26, 1992, abandoned.

[30] Foreign Application Priority Data

Mar. 29, 1991 [JP] Japan ..... 3-20159[U]

[51] Int. Cl.[5] ..... H01R 13/40

[52] U.S. Cl. ..... 439/595; 439/491; 439/598; 439/752

[58] Field of Search ..... 439/491, 595-600, 439/752

[56] References Cited

U.S. PATENT DOCUMENTS

| | | | |
|---|---|---|---|
| 4,061,410 | 12/1977 | Kubik | 439/491 |
| 4,717,359 | 1/1988 | Rahrig et al. | 439/598 |
| 4,867,705 | 9/1989 | Yuasa | 439/595 |
| 5,108,319 | 4/1992 | Tsuji et al. | 439/595 |
| 5,141,452 | 8/1992 | Yoneda et al. | 439/595 |

FOREIGN PATENT DOCUMENTS 58-111281 7/1983 Japan .

*Primary Examiner*—Paula A. Bradley

*Attorney, Agent, or Firm*—Wigman, Cohen, Leitner & Myers

[57] ABSTRACT

A connector comprises a connector housing with a plurality of terminal accommodating chambers and a rear holder which to be inserted into and coupled with a rear end of the connector housing for restricting pulling-up of terminals inserted respectively into the terminal accommodating chambers. A stopper body which is coupled on a rear section of the rear holder through a hinge section and which is interchangeable between a laid-down condition extending along an inserting direction of the rear holder and a standing-up condition which intersects with the laid-down condition is engaged with the rear end of the connector housing in a tentative locking state when the stopper body is biased into the standing-up condition. The stopper body is brought to the laid-down condition in a complete locking state so as to be accommodated within the rear end of the connector housing. A plurality of indication marks are displayed on a rear face of the stopper body when the stopper body is in the standing-up condition to indicate accommodation of the terminals into the respective terminal accommodating chambers.

5 Claims, 8 Drawing Sheets

CONNECTOR

This is a continuation of co-pending application Ser. No. 07/857,960 filed on Mar. 26, 1992, now abandoned.

BACKGROUND OF THE INVENTION

1. Field of the Invention

The present invention relates to a connector offered as connection of wire harnesses for vehicles, or the like.

2. Description of the Prior Art

An example of a conventional connector of this kind, is a coupler connecting unit 1 as shown in FIG. 1 of the attached drawings, which is disclosed in Japanese Patent Laid-Open No. 58-111281. The coupler connecting unit 1 is used in wire harnesses for a two-wheeled vehicle, motor bicycle or the like, and is provided for connecting various electric equipment parts or elements, electric sources, and the like to one other. A coupler 3 as shown in FIGS. 1 and 2 is mounted on electric wires 7. The coupler 3 is provided with a plurality of wire inserting holes 5. The wires 7 are inserted respectively into the wire inserting holes 5 from above. Metallic terminal parts or elements 9 are caulked and connected respectively to the wires 7 under a condition in which a forward end of each of the wires 7 is exposed downwardly of the coupler 3. When each of the terminal elements 9 is inserted into one of the corresponding the wire inserting holes 5 from beneath the coupler 3, the terminal element 9 is latched to or engaged with the coupler 3.

In addition, when a vehicle or automobile car is upgraded, the number of wires to be wired increases accordingly, and the vehicle is brought to a so-called multipolarity. When multipolarity exists, the wires 7 to be inserted respectively into the plurality of inserting holes 5 are decided in kind or type. However, if there are no markings, there is fear that the wires 7 will be erroneously inserted into incorrect inserting holes 5. For this reason, as shown in FIG. 2, the coupler 3 is provided with a flange 11 at its upper end. Numerals 13 are marked on the flange 11, to indicate the wire inserting holes 5 into which the wires 7 are to be inserted.

However, in such a conventional arrangement, the bulging flange 11 must be provided at about the upper end of the coupler 3 in order to mark the numerals 13. This is extremely disadvantageous for miniaturization of the unit. Further, since the flange 11 is always exposed, dirt, dust, oil, and the like often adhere to an upper face of the flange 11, or the surface of the flange 11 is shaved off due to rubbing with other elements resulting in the disappearance of numerals 13. Thus, there is a fear that erroneous insertion of the wires 7 will result during disassembly, repair and the like.

SUMMARY OF THE INVENTION

In view of the above, an object of the present invention is to solve the aforementioned problems in the prior art through the introduction of a connector which is advantageous in miniaturization, and in which adhering of dust, dirt and oil, rubbing with respect to other elements, and the like are restrained so that inserting indication can be maintained for a long period of time.

In order to solve the above-discussed problem, according to the present invention, there is provided a connector comprising:

a plurality of terminal accommodating chambers respectively accommodating terminals therein;

a connector housing having the plurality of terminal accommodating chambers;

a rear holder provided so as to be inserted into and coupled with a rear end of the connector housing, for restricting pulling-up of the terminals inserted into the terminal accommodating chambers;

a pair of tentative locking sections provided respectively on the connector housing and on the rear holder, for being tentatively locked on the rear holder when it is halfway inserted into and coupled with the connector housing;

a pair of complete locking sections provided respectively on the connector housing and on the rear holder, for being completely locked at completion of insertion and coupling of the rear holder;

a hinge section on the rear holder;

a stopper body coupled to a rear section of the rear holder through the hinge section, the stopper body being interchangeable between a laid-down condition extending along an inserting direction of the rear holder and a standing-up condition which intersects with the laid-down condition, the stopper body being engaged with the rear end of the connector housing in a tentative locking state when the stopper body is biased into the standing-up condition, and the stopper body being brought to the laid-down condition when in a complete locking state so as to be accommodated within the rear end of the connector housing; and a plurality of indication marks displayed on a rear face of the stopper body when in the standing-up condition, to indicate accommodation of the terminals into the respective terminal accommodating chambers.

With regard to the operation of the invention, when the terminals are accommodated in the connector housing, the rear holder is first inserted halfway into the rear end of the connector housing, and the rear holder is tentatively locked to the connector housing by the tentative locking sections. Under the tentative locking, the stopper body under the standing-up condition is engaged with the rear end of the connector housing in order to restrict the further insertion of the rear holder. Thus, further insertion exceeding a location of the tentative locking is restricted. Under this condition, the terminals with respective wires are inserted through the rear end of the rear holder, and are accommodated respectively in the terminal accommodating chambers in the connector housing. Under this condition, correct insertion of each terminal into a corresponding terminal accommodating chamber may be executed by viewing the indication marks on the stopper body. Subsequently, the stopper body is brought to the laid-down condition in order to further execute insertion of the rear holder so that the rear holder may be completely locked with the connector housing by the complete locking sections.

DETAILED DESCRIPTION OF THE PREFERRED EMBODIMENTS

An embodiment of the invention will be described hereinafter.

Figure 1:
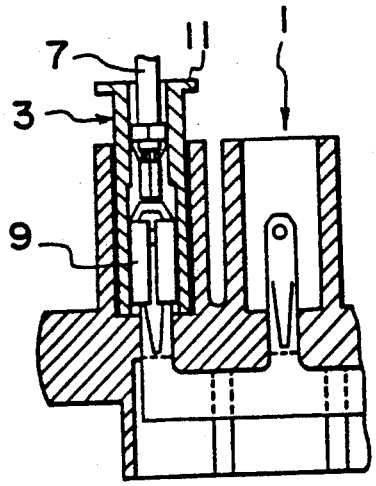
FIG.1 PRIOR ART
FIG. 1 is a cross-sectional view of a coupler connecting unit according to a conventional example.
Figure 2:
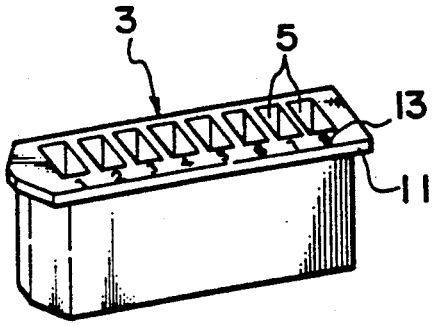
FIG.2 PRIOR ART
FIG. 2 is a perspective view of the coupler illustrated in FIG. 1.
Figure 3:
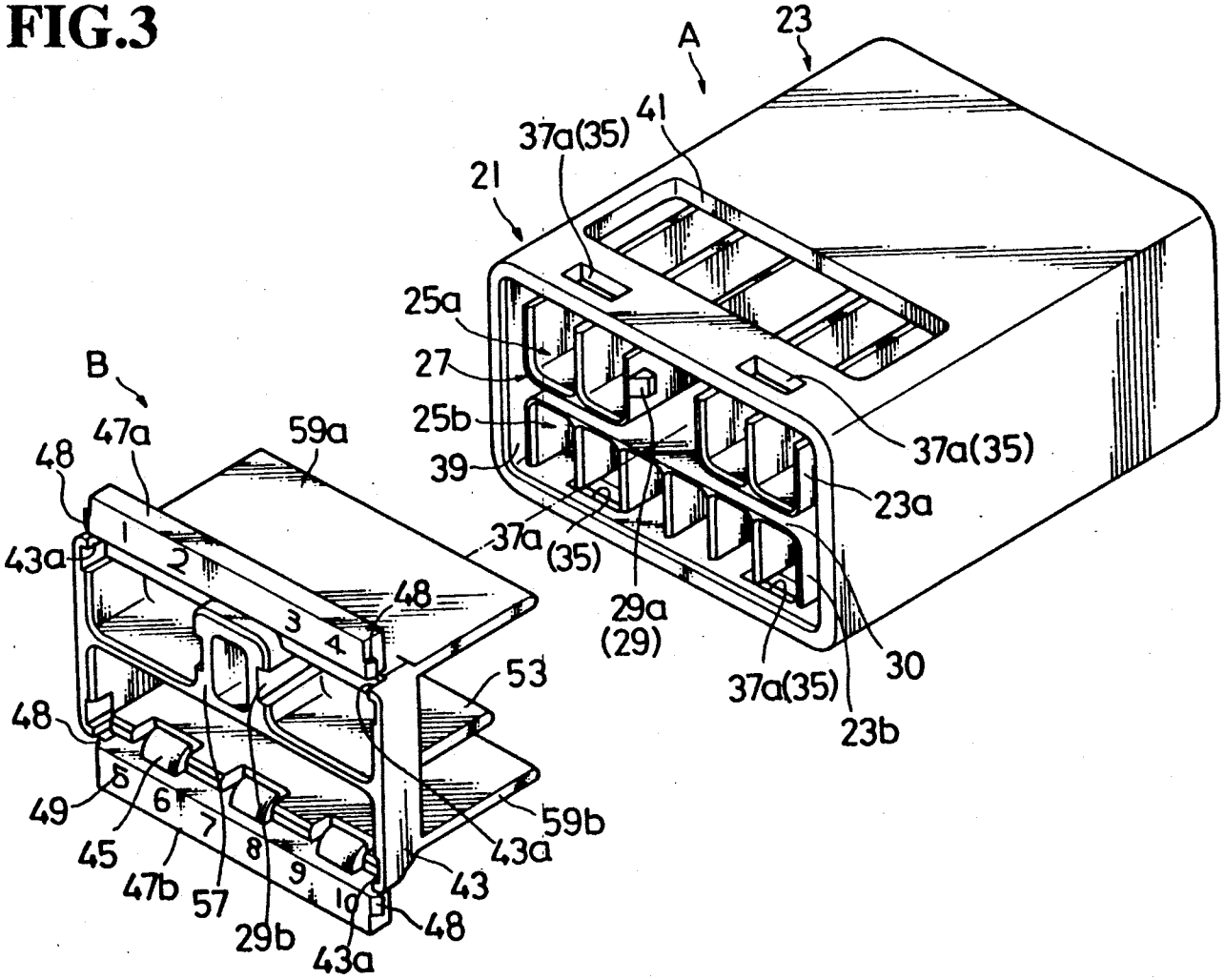
FIG. 3 is a perspective view of a connector unit according to an embodiment of the invention.
Figure 4:
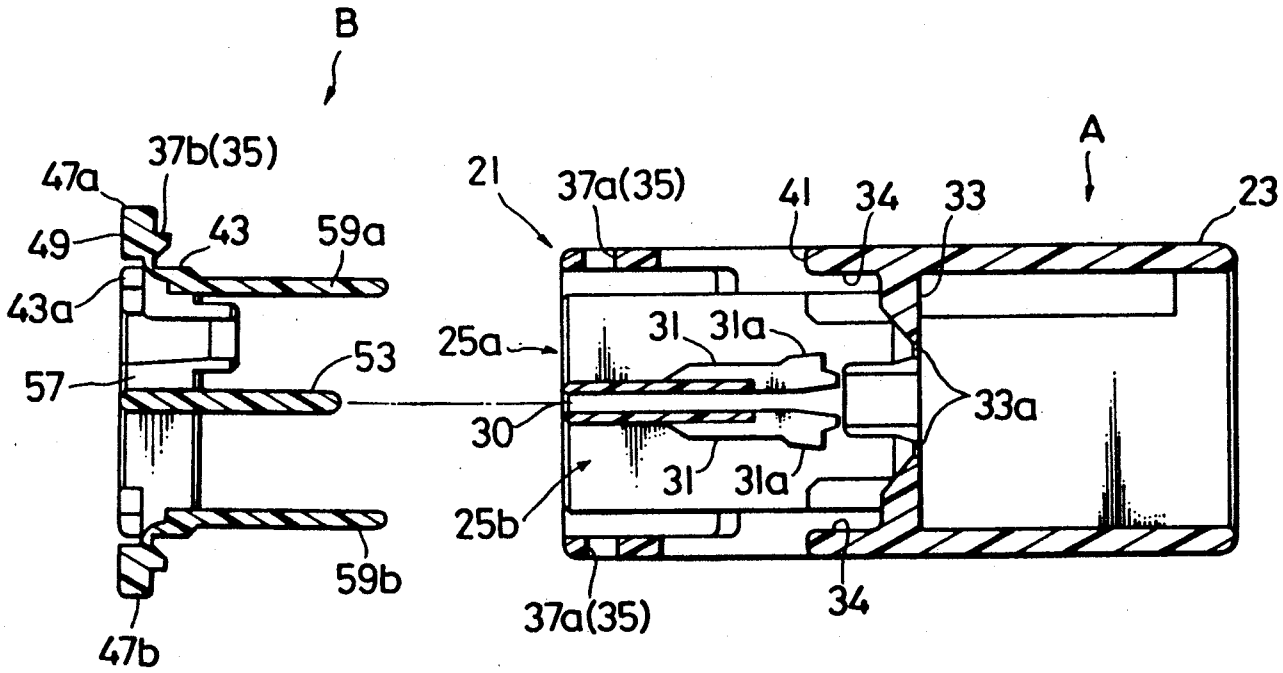
FIG. 4 is a cross-sectional view of the arrangement illustrated in FIG. 3.

Referring first to FIGS. 3 and 4, a connector which comprises a connector housing A and a rear holder B is shown.

The connector housing A is formed or molded integrally of synthetic resin, and comprises a terminal receiving or accommodating housing section 21 and a hood section 23. A terminal receiving or accommodating body section 27, within which a plurality of terminal accommodating chambers 25*a* and 25*b* are arranged, is provided within the terminal accommodating housing section 21. The terminal accommodating chambers 25*a* and 25*b* are formed respectively by U-shaped walls 23*a* and 23*b* each having U-shaped cross-section, and are arranged in an upper and lower, two stage manner. A center of the upper stage is so formed as to be surrounded by the terminal accommodating chambers 25*a* on both sides, and left- and right-hand surfaces (only one shown in FIG. 3) of the center are provided respectively with temporal or tentative locking projections 29*a* which form one of a pair of tentative locking portions 29. The tentative locking portions 29 are arranged in the connector housing A and the rear holder B, and are in the ones which are tentatively locked on the rear holder B when it is halfway inserted into the connector housing A.

A space between the upper and lower two-stage terminal accommodating chambers 25*a* and 25*b* forms a guide groove 30 for insertion of the rear holder B as illustrated in FIG. 4. Furthermore, flexible engaging pieces 31 are provided respectively within the terminal accommodating chambers 25*a* and 25*b* which are arranged in an upper and lower, two stage manner. Each of the flexible engaging pieces 31 is provided with an engaging projection 31*a*. Moreover, an intermediate wall 33 is provided at a location in front of the terminal accommodating chambers 25*a* and 25*b*. The intermediate wall 33 is provided therein with communicating openings 33*a* which communicate with the hood section 23. The intermediate wall 3 has a rear face which is provided at its upper and lower portions with a pair of presser walls 34.

The terminal accommodating housing section 21 has a rear end on which both upper and lower walls are provided respectively with a pair of complete or perfect locking holes 37*a* which form one of a pair of complete locking sections 35. The complete locking sections 35 are arranged between the connector housing A and the rear holder B, and execute a complete locking state when insertion of the rear holder B into the connector housing A has been completed.

As shown in FIG. 3, an inserting space portion 39 is arranged between the terminal accommodating body section 27 and an inner surface of the terminal accommodating housing section 21 of the connector housing A. This inserting space portion 39 opens at the rear end of the connector housing A and is provided for insertion into and connection with the rear holder B. The terminal accommodating housing section 21 has an upper face which is provided with a window 41, so that the terminal accommodating chambers 25*a* at the upper stage are partially exposed.

Figure 5:
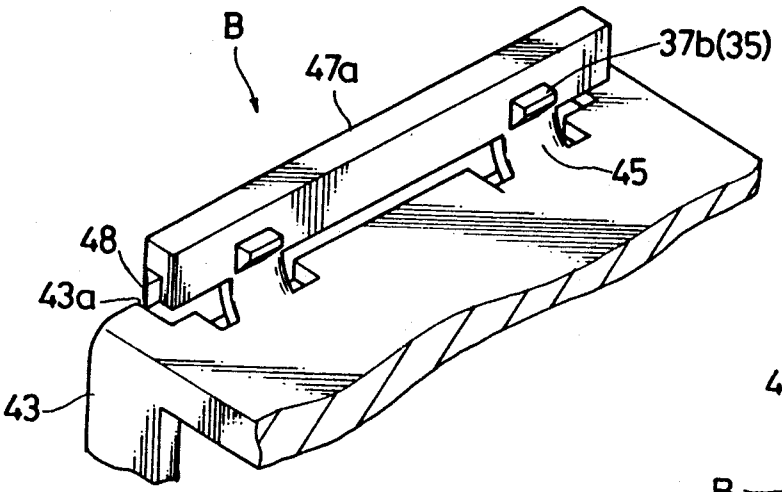
FIG. 5 is a fragmentary perspective view showing a front face of a stopper body when in a standing-up condition.
Figure 7:
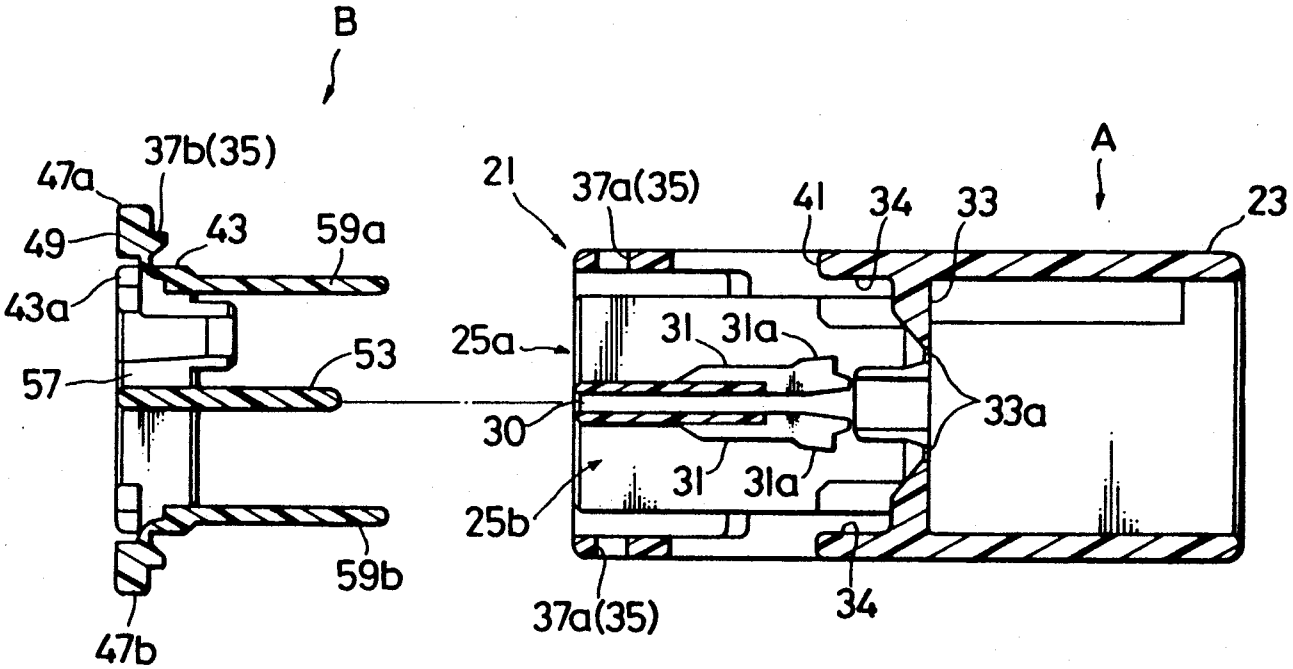
FIG. 7 is a view for explanation, showing a connector housing and a rear holder before operation.

The rear holder B has a generally rectangular cross-section, and is formed by a frame body 43 which is capable of being inserted into the inserting space portion 39. As shown in FIGS. 3 to 5, a pair of stopper bodies 47*a* and 47*b* are provided respectively at upper and lower locations of the frame body 43 through integral hinge portions 45 as viewed in an inserting direction. Each of the stopper bodies 47*a* and 47*b* is interchangeable between a laid-down condition extending along the inserting direction of the rear holder B and a standing-up condition which intersects with the laid-down condition by the hinge portions 45. Further, each of the stopper bodies 47*a* and 47*b* is biased toward the standing-up condition by elasticity of the hinge portions 45 illustrated in FIG. 3. Each of the stopper bodies 47*a* and 47*b* is formed into a rectangular plate-like a part of each of the stopper bodies 47*a* and 47*b* can be received within a corresponding pair of recesses 43*a* in the frame body 43 when in the laid-down condition. Both the stopper bodies 47*a* and 47*b* include side faces thereof which are provided respectively with projections 48 which are to be engaged with corresponding recesses 43*a* provided in the frame body 43. Furthermore, when in the laid-down condition, both the stopper bodies 47*a* and 47*b* have respective lengths (in a lateral direction) and widths which are capable of being inserted into the inserting space portion 39 within the terminal accommodating housing section 21. Moreover, when in the standing-up condition, the stopper bodies 47*a* and 47*b* have respective rear faces thereof which are provided with indication marks 49 which indicates accommodation of the terminals into the respective terminal accommodating chambers 25*a* and 25*b*. With regard to the indication marks 49 in which numerals are marked in this embodiment, for example, 1~4 are marked in the upper-stage stopper body 47*a* while 5~10 are marked on the lower-stage stopper body 47*b*. These numerals correspond respectively to positions and numbers of the terminal accommodating chambers 25*a* and 25*b*. Further, the stopper bodies 47*a* and 47*b* have respective front surfaces thereof when in the standing-up condition, which, as illustrated in FIG. 5, are provided respectively with a pair of complete locking projections 37*b* forming the other members of the complete locking sections 35.

As shown in FIGS. 3 and 4, the inside of the frame body 43 of the rear holder B is provided with a slide stopper wall 53 which is slidingly fitted in the guide groove 30. The frame body 43 has an interior thereof which is divided into upper and lower two-stage spaces which correspond to the terminal accommodating chambers 25*a* and 25*b*, respectively. The slide stopper wall 53 is provided with a fitting portion 57 which is located in a center portion of said upper-stage space and which is fitted into a space between a left-hand space section and a right-hand space section of the upper-stage terminal accommodating chamber 25a. The fitting portion 57 has tentative locking recesses 29b forming the other members of the tentative locking portion 29 on both the left and right sides thereof. These tentative locking recesses 29b and tentative locking portion 29 create a tentative locking state while the rear holder B is on the terminal which is halfway inserted into the connector housing A.

Furthermore, the frame body 43 is provided with guide plates 59a and 59b which can be inserted into the inserting space portion 39 on the upper and lower parts thereof.

In connection with the above, the slide stopper wall 53 and the guide plates 59a and 59b may be formed into a comb-teeth-like configuration or the like.

Next, the assembly procedure will be described. Operation of the indication marks 49 will first be described using FIG. 6, and operation from the tentative locking to the complete locking will subsequently be described using FIGS. 7 through 12.

Figure 6:
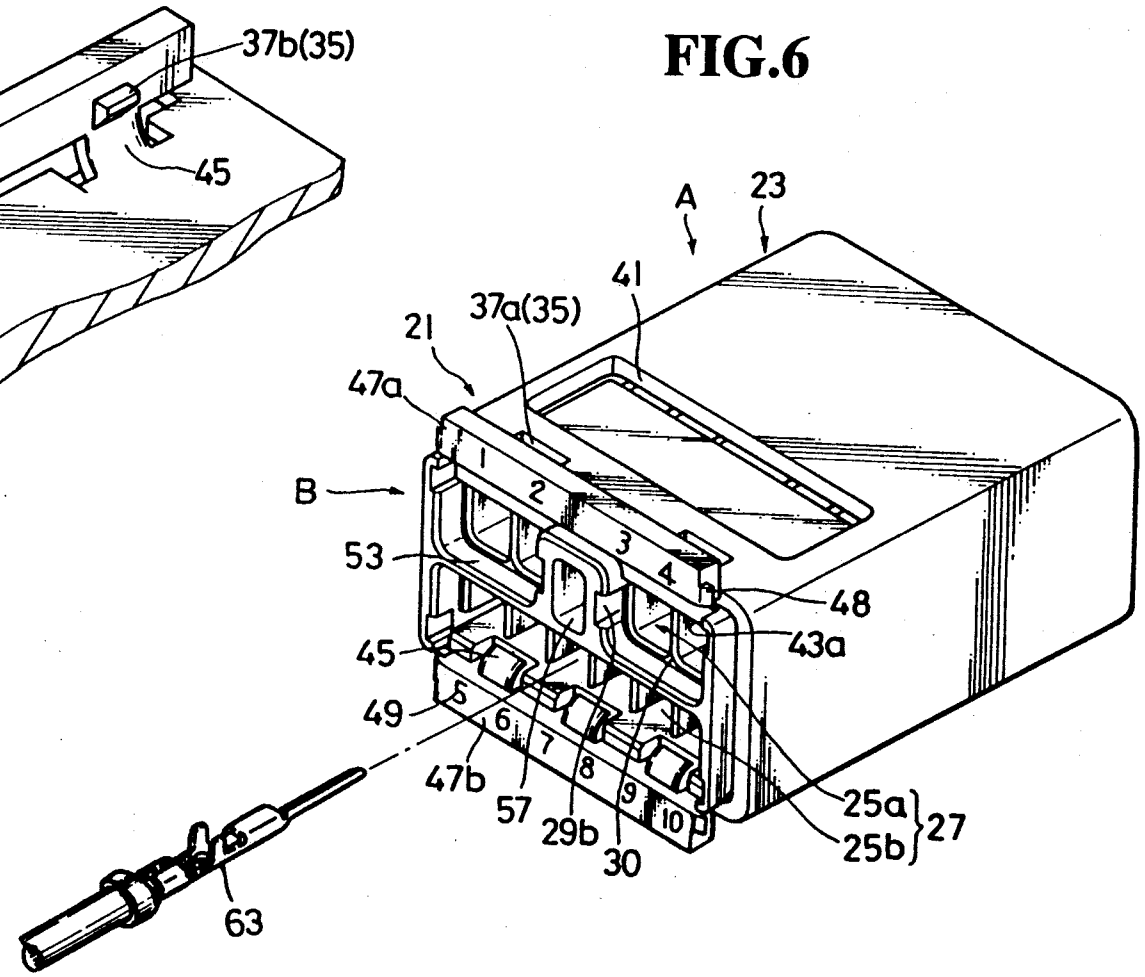
FIG. 6 is a perspective view for explanation of operation of the connector illustrated in FIG. 3.

First, at assembly, the rear holder B is inserted into the inserting space portion 39 at the rear end of the connector housing A, so that the connector is brought to a condition illustrated in FIG. 6. Under this condition, the guide plates 59a and 59b of the rear holder B are fitted in the inserting space portion 39; the slide stopper wall 53 is slidingly fitted in the guide groove 30 in the terminal accommodating body section 27; the fitting portion 57 of the rear holder B is fitted in the upper-stage center of the terminal accommodating body section 27; the tentative recesses 29b are so engaged as to be clamped respectively by both the tentative locking projections 29a; and the rear holder B is brought to a tentative locking condition with respect to the connector housing A. At this time, the stopper bodies 47a and 47b being biased by the hinge portion 45 are in the standing-up condition. The indication marks 49 are directed or oriented rearwardly so that an operator can easily view the indication marks 49. Accordingly, the operator can easily insert a terminal 63 into any of the terminal accommodating chambers 25a and 25b while viewing the indication marks 49. Thus, it is possible to prevent erroneous or incorrect insertion from occurring. In this connection, the indication marks may be enlarged in order to improve visibility further.

Figure 8:
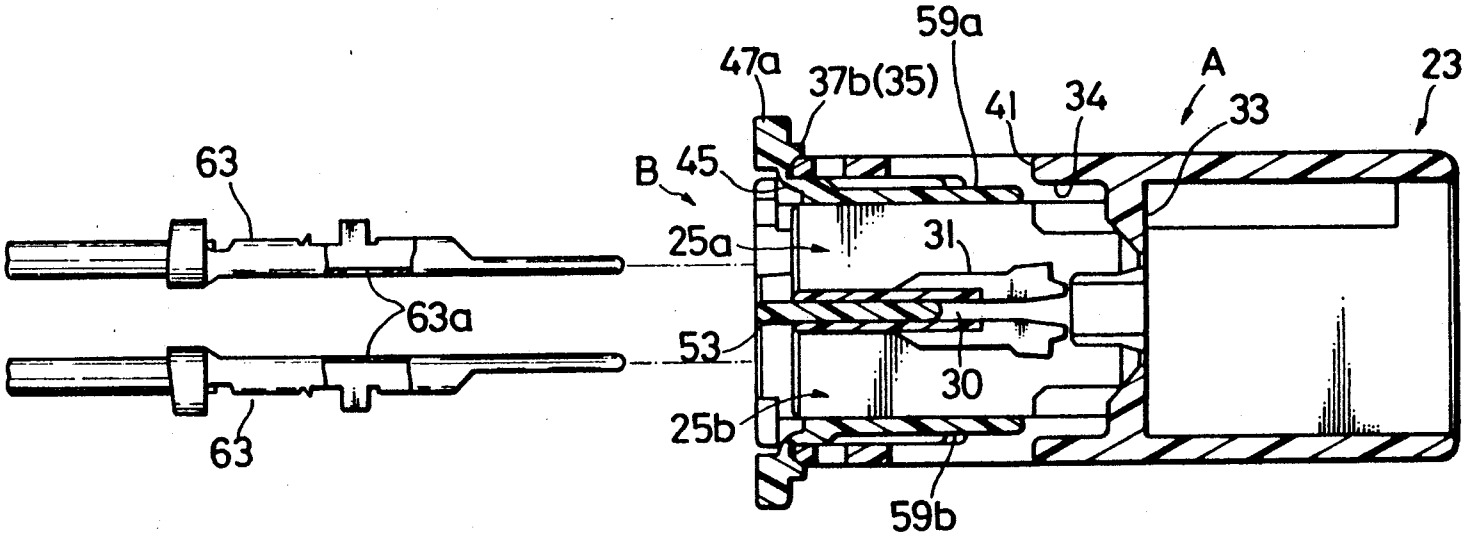
FIG. 8 is a view for explanation, similar to FIG. 7, but showing the operation.
Figure 9:
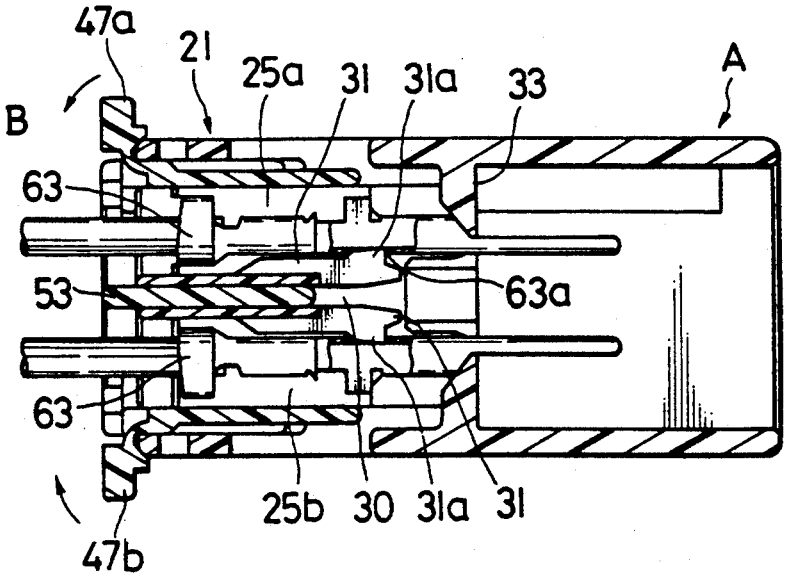
FIG. 9 is a view for explanation, similar to FIG. 7, but showing the operation.

Next, the tentative locking state and the complete locking state will be described. The condition illustrated in FIG. 6 corresponds to the condition illustrated in FIG. 8 while FIGS. 7 through 12 show the operation sequence. The tentative locking condition of the rear holder B is shown in FIG. 8 in transition from the condition shown in FIG. 7. Under this condition, since the stopper bodies 47a and 47b are engaged with the rear end of the housing section 21 which is under the standing-up condition, there is no case where the rear holder B is carelessly or inadvertently pushed into the housing section 21. Thus, it is possible to securely maintain that the tentative locking state. Under this tentative locking state, each terminal 63 is inserted into one of the terminal accommodating chambers 25a and 25b as shown in FIG. 9.

In FIG. 9, each of the terminals 63 is abutted against the intermediate wall 33 and is perfectly inserted. Under this condition, the engaging projections 31a of the respective flexible engaging pieces 31 are engaged respectively with engaging holes 63a in the respective terminals 63. Further, the forward ends of the respective terminals 63 are contained inside the hood section 23, protruding from the respective communicating openings 33a of the intermediate wall 33.

Figure 10:
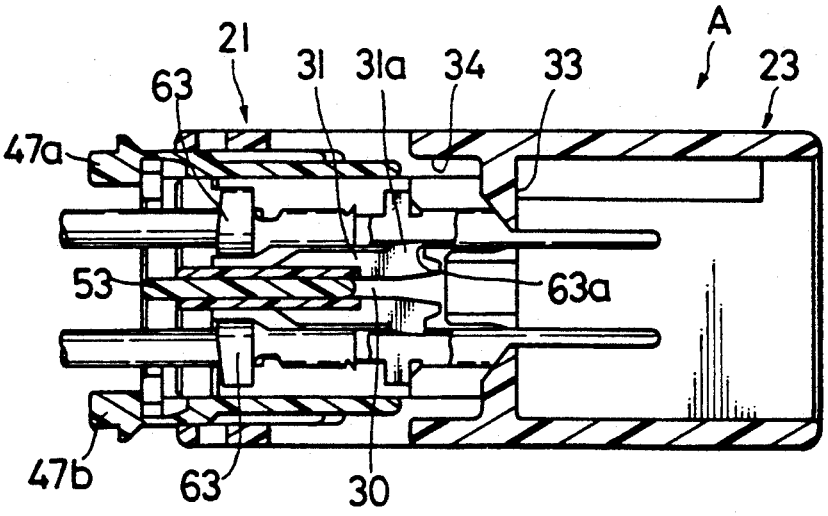
FIG. 10 is a view for explanation, similar to FIG. 7, but showing the operation.

The stopper bodies 47a and 47b are then moved angularly so as to be brought to the laid-down condition as illustrated in FIG. 10. At this time, the projections 48 on the stopper bodies 47a and 47b are engaged respectively with the sides of the recesses 43a so that the laid-down condition is provisionally fastened.

Figure 11:
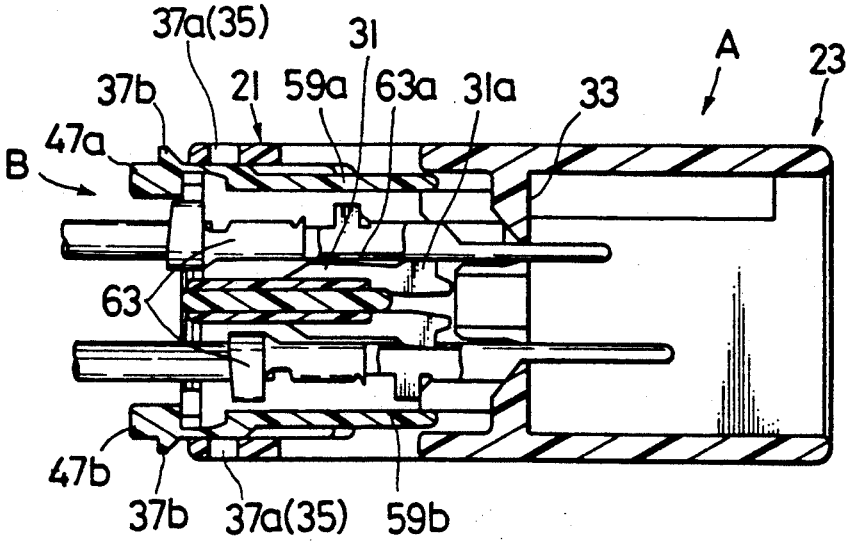
FIG. 11 is a view for explanation, similar to FIG. 7, but showing the operation.

If the terminal 63 is inserted completely like the terminal 63 in the upper-stage of the connector housing 63 illustrated in FIG. 11, the engaging projection 31a of the flexible engaging piece 31 is remains at a location ahead of the engaging bore 63a in the terminal 63 so that the flexible engaging piece 31 is flexed or bent. Under this condition, if an attempt is made to lay down the stopper bodies 47a and 47b to insert the rear holder B further into the terminal accommodating housing section 21, the slide stopper wall 53 is abutted against the flexible engaging piece 31 so that the slide stopper wall 53 cannot be inserted further. Thus, the operator can easily judge whether the terminal 63 is halfway inserted and is incapable of being engaged. Therefore, the operator may further push the terminal 63 in the upper-stage, so that the engaging projection 31a of the flexible engaging piece 31 can engage with the engaging bore 63a in the terminal 63.

Figure 12:
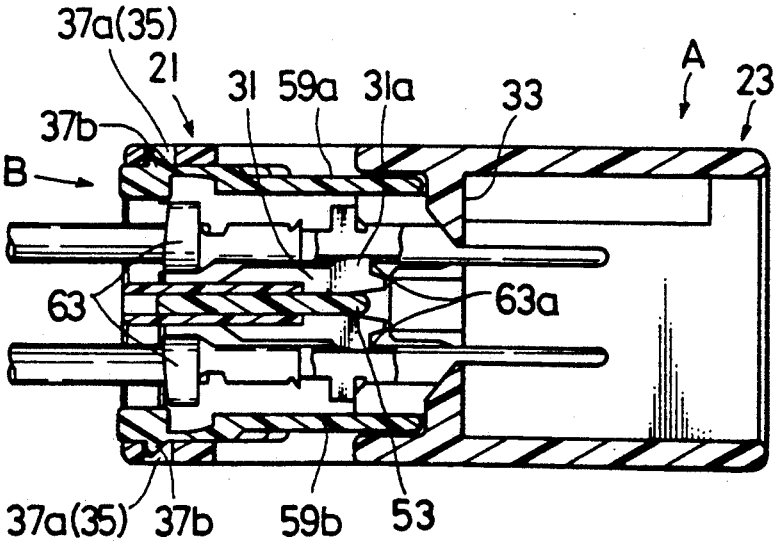
FIG. 12 is a view for explanation, similar to FIG. 7, but showing the operation.

While the rear holder B is further inserted, the forward ends of the respective guide plates 59a and 59b of the rear holder B get respectively into the inward sides of the respective presser walls 34 of the housing section 21 so that vertical movement of the guide plates 59a and 59b is restricted as shown in FIG. 12. The slide stopper wall 53 passes through the guide groove 30 and is interposed between the flexible engaging pieces 31. Therefore, flexure of the flexible engaging pieces 31 is restricted so that it may be ensured that the terminals 63 are prevented from being disengaged from the respective engaging projections 31. Furthermore, under this condition, the rear holder B is completely locked by the fact that the complete locking projections 37b are engaged respectively with the complete locking holes 37a on the side of the housing section 21.

As shown in FIG. 12, since the stopper bodies 47a and 47b are received into the inserting space portion 39 in the terminal accommodating housing section 21, there is no case where the indication marks 49 on the stopper bodies 47a and 47b illustrated in FIG. 6 are exposed to the outside. Accordingly, there is no case where the indication marks 49 are exposed to adhesion of dust, dirt or oil or shaving off by rubbing of other elements of components. Thus, it is possible to maintain the indicating function of the indication marks 49 for a long period of time. Moreover, reception of the stopper bodies 47a and 47b is substantially advantageous in miniaturization of the unit.

In connection with the above, during the drawing-out or pulling-out operation of the terminals 63, the rear holder B is pulled out of the housing section 21, and retention or pressing-down of the flexible plate arms 59a and 59b by the respective presser walls 34 is released. By doing so, it is possible to execute pulling-out of the terminals 63.

In connection with the above, the indication marks are not limited to actual numerals. Any other signs or marks may be used as the indication marks. Further, the indicating marks are not limited to marking, but various means such as printing and the like are possible.

What is claimed is:

1. A connector comprising:

a plurality of terminal accommodating chambers respectively accommodating terminals therein;

a connector housing having the plurality of terminal accommodating chambers;

a rear holder provided so as to be inserted into and coupled with a rear end of said connector housing for restricting pulling-up of the terminals inserted into said terminal accommodating chambers;

a pair of tentative locking sections provided respectively on said connector housing and on said rear holder, for being tentatively locked on said rear holder when it is halfway inserted into and coupled with the connector housing;

a pair of complete locking section provided respectively on said connector housing and on said rear holder, for being completely locked at completion of insertion and coupling of said rear holder;

a hinge section on said rear holder;

a stopper body coupled to a rear section of said rear holder through said hinge section, said stopper body being interchangeable between a laid-down condition extending along an inserting direction of said rear holder and a standing-up condition which intersects with said laid-down condition, said stopper body being engaged with the rear end of said connector housing in a tentative locking state when said stopper body is biased into the standing-up condition, and said stopper body being brought to the laid-down condition when in a complete locking state so as to be accommodated within the rear end of said connector housing; and a plurality of indication marks displayed on a rear face of said stopper body when in the standing-up condition, to indicate terminal accommodating of said terminals into the respective terminal accommodating chambers.

2. A connector according to claim 1, wherein said complete locking section includes a complete locking hole provided in a wall of said connector housing at the rear end thereof, and a complete locking projection provided on a front face of said stopper body under the standing-up condition for being engaged with said complete locking hole at the complete locking state.

3. A connector according to claim 1, wherein said connector housing is provided at a rearward section thereof with a terminal accommodating body section in which said plurality of terminal accommodating chambers are arranged side b side.

and wherein said terminal accommodating body section is provided with an inserting space section for insertion and coupling of said rear holder at a location between said terminal accommodating body section and an inner surface of said connector housing, said internal space section opening toward the rear end of said connector housing.

4. A connector according to claim 1, wherein said connector housing has said plurality of terminal accommodating chambers within said housing in an upper and lower, two stage manner, and there is provided a guide groove for insertion of said rear holder at a location between said two stages;

wherein said rear holder has a slide stopper wall which is inserted into said guide groove in said connector housing;

and wherein said terminal accommodating chambers are provided respectively with flexible engaging pieces which are formed respectively with engaging projections, said engaging projections being engaged respectively with engaging holes provided in said terminals under a condition that said terminals are completely inserted, said engaging projections being arranged so that said engaging projections remain at locations ahead said engaging holes in said terminals when the terminal is incompletely inserted, thereby flexing said flexible engaging pieces, preventing said slide stopper wall of said rear holder from being inserted into the connector housing in a forward direction, and preventing complete locking condition other than that in which said terminals are engaged respectively at predetermined positions.

5. A connector according to claim 4, wherein said slide stopper wall extends through said guide grooves so as to be interposed between said flexible engaging pieces when in said complete locking state, to restrict flexure of said flexible engaging pieces, thereby preventing said engaging projection of the flexible engaging piece from disengaging from said engaging hole in the terminal.

* * * * *